United States Patent [19]

Hund et al. Best Available Copy

[11] 4,140,813

[45] Feb. 20, 1979

[54] METHOD OF MAKING LONG-TERM ELECTRODE FOR ELECTROLYTIC PROCESSES

[75] Inventors: Helmut Hund, Schneidhain, Helmut Schaefer, Hofheim, Dieter Bergner, Kelkheim, all of Fed. Rep. of Germany

[73] Assignee: Hoechst Aktiengesellschaft, Frankfurt, Fed. Rep. of Germany

[21] Appl. No.: 829,100

[22] Filed: Aug. 30, 1977

Related U.S. Application Data

[63] Continuation of Ser. No. 605,467, Aug. 15, 1975, abandoned, which is a continuation of Ser. No. 430,559, Jan. 3, 1974, abandoned.

[30] Foreign Application Priority Data

Jan. 5, 1973 [DE] Fed. Rep. of Germany ..... 2300422

[51] Int. Cl.[2] ..... B05D 3/06

[52] U.S. Cl. ..... 427/34; 204/290 F; 427/58; 427/423

[58] Field of Search ..... 427/34, 423, 58; 204/290 F, 290 H

[56] References Cited

U.S. PATENT DOCUMENTS

| | | | |
|---|---|---|---|
| 3,318,730 | 5/1967 | Kreiselmaier | 427/423 |
| 3,491,014 | 1/1970 | Bianchi et al. | 204/290 F |
| 3,562,008 | 2/1971 | Martinsons | 204/290 F |
| 3,632,498 | 1/1972 | Beer | 204/290 F |
| 3,657,102 | 4/1972 | Keith et al. | 204/290 F |
| 3,663,280 | 5/1972 | Lee | 204/290 F |
| 3,711,385 | 1/1973 | Beer | 204/290 F |
| 3,773,555 | 11/1973 | Cotton et al. | 427/123 |

*Primary Examiner*—John H. Newsome

*Attorney, Agent, or Firm*—Curtis, Morris & Safford

[57] ABSTRACT

A long-term electrode for electrolytic processes comprises a skeleton of a metal passive under the conditions of the electrolytic process and an electrically conductive first coating which is bound to the metal skeleton in a tightly adhesive manner covering at least part of the metal surface and to which is applied electrochemically active substances selected from the group of platinum metals and platinum metal compounds.

The first coating is produced on the metal surface by flame or plasma spraying. Subsequently at least one electrochemically active substance containing a platinum metal or oxide thereof is formed by a thermal degradation process and anchored to the pores of the first coating.

14 Claims, No Drawings

METHOD OF MAKING LONG-TERM ELECTRODE FOR ELECTROLYTIC PROCESSES

This is a continuation of application Ser. No. 605,467, filed Aug. 15, 1975, which is a continuation of Ser. No. 430,559, filed Jan. 3, 1974 both now abandoned.

The present invention relates to metal anodes which, for some years, besides the graphite anodes, have been used in the electrolysis of alkali chloride. The known metal anodes are substantially composed of titanium as carrier material and a coating made of a mixture of titanium and noble metal oxides. Metal anodes are economically advantageous especially in the case where they can be used at high current densities. At present, the normal current densities in manufacturing plants are from 10 to 12 kA/m$^2$, that is, they are in a range where also the use of graphite anodes is still profitable when employed with solutions of sulfate-free salt. At higher current densities, even in the case of using metal anodes, the difficulty arises of finding out an economic ratio between the lifetime depending on corrosion and the required amount of noble metal. An anode having the hitherto usual life of from 12 to 18 months at 10 kA/m$^2$ requires about 10 g/m$^2$ of noble metal. When a longer life at the same current density is desired or when the current density shall be increased while maintaining the lifetime of the anode, an increase of the noble metal amount per unit of surface area would be necessary. However, this cannot be realized indefinitely, since the factor of cost is considerable on the one hand, and on the other, it is not possible to coat the anode surface with noble metal oxide layers of any thickness whatsoever in such a manner that the layers adhere to this surface even under increased stress on the anodes and that this coating proves also to be economic and profitable.

Furthermore, those anode coatings hitherto known which are used in industrial practice are distinguished by a relatively poor wettability by mercury. However, at high current densities (short circuit currents), on contact with amalgam, there is the disadvantage that the active anode coating is relatively rapidly taken off and that a heavy short circuit occurs on the metallic titanum surface now laid bare (metallic resistance) which short circuit may cause the destruction of at least part of the anode.

For economic reasons, the user of metal anodes is highly interested in anode qualities which offer a multiple of the lifetime at high current densities than hitherto normal, since removal or insertion of anodes, production losses, transport (freight, package, storage room) and reactivation (preparation of the anodes) considerably increase the cost of a manufacturing plant, and the same goes for the case where electrodes are damaged or destroyed by short circuits.

The hitherto known anode coatings most used in practice (H. Beer, German Auslegeschrift No. 1,671,422; O. de Nora, German Offenlegungsschrift No. 1,814,567) are carried out as follows: after a mechanical (for example sandblasting) and/or chemical treatment of the surface of the film-forming metal, a film of an activating substance (oxide mixture) is directly applied to the surface from solutions or suspensions, which film is subsequently decomposed by a heat treatment.

Furthermore, methods have been proposed to pretreat the surface of the film-forming carrier metal in such a manner that the subsequently applied noble metal or noble metal oxide layer is thoroughly anchored on the surface.

It has for example been proposed to coat the titanium nucleus with an insulation layer by anodic oxidation or by thermal or chemical methods. In these cases, the oxide film is produced out of the metal in an extremely thin layer (German Auslegeschrift No. 1,115,721, German Offenlegungsschrift No. 1,571,721). However, these very thin oxide layers do not bring about a better, but a considerably poorer adhesion of the activating substances.

A further method relates to the formation of a film-forming surface layer on the metal carrier from solutions of film-forming metals, for example from a solution of $Ti^{4+}$ in sulfuric acid, or isopropyl titanate is applied to the carrier and baked. Such a film-forming surface layer has a weight of about 10 g/m$^2$, a whitish color, and it is non-conductive. It is a titanium oxide of the formula $TiO_2$ having an anatase crystal structure. When used as anode, passivation occurs immediately (German Offenlegungsschrift No. 2,063,238). Since it has been observed that the lifetime of the oxide layers produced on the film-forming metal according to the various methods cited above is insufficient (rapid change of temperatures causes tensions because of the different contraction behavior in the interface), a further method provides anchoring a sintered, porous carrier layer of a film-forming metal on the metal anode, which layer is sintered onto the anode in the form of metal powder (German Offenlegungsschrift No. 2,035,212).

Furthermore, the activation of metal anodes by application of oxide mixtures containing the electrochemically active substances by means of a plasma burner is known (German Auslegeschrift No. 1,671,422). However, this process is unsuitable for compounds of ruthenium and iridium as electrochemically active substances, because these platinum metals, depending on the coating conditions, become volatile in the form of higher oxides, or are applied to the metal carrier in the form of metals instead of in the form of oxide mixtures as desired.

No verifiable operation methods are hitherto known which allow the preparation of anodes attaining a lifetime of more than 18 months at higher current densities than being normal nowadays (for example 13 kA/m$^2$). Also, there are no proposals made hitherto which aim at the autoregulative formation of a resistance with respect to suppression or prevention of short circuits.

It is therefore the object of the present invention to provide an industrially utilizable method for the coating of anodes which, at the high current densities necessary for the electrolysis of alkali chloride, gives the coating a lifetime far superior to that of hitherto known anode coatings, and which prevents the development of short circuits by autoregulative formation of an effective resistance at the menaced point.

In accordance with the present invention, there is provided a process for the preparation of a long-term electrode which is capable of conducting and withstanding relatively high current densities in electrolytic processes, comprising producing a first coating of titanium oxide on the surface of a metal passive under the conditions of the electrolytic process, applying a solution or suspension containing a platinum metal compound to the first coating and converting the solution or suspension subsequently by heat treatment into an electrochemically active substance containing a platinum metal or oxide thereof. The first coating is produced in the amount of from 50 to 6000 g/m$^2$ by flame or plasma spraying the titanium oxide onto the surface of the metal. The passive metal preferably is titanium or a titanium alloy.

That part of the metallic basal surface which is not covered with the electrically conductive titanium oxide and the electrochemically active substance containing platinum metal or oxides thereof does not take part in the electrolysis when the electrode is used as anode. The basis metal is generally titanium or the other elements of the groups IVB to VIB of the Periodic System, but there may be used also alloys of these metals with themselves or with other metals (for example Cu, Al, Sn, Pd).

According to the present invention, the first coating of the electrode consists of one or more titanium oxides $TiO_y$ ($0.1 \leqq y \leqq 1.999$), especially of oxides $TiO_y$ ($1.75 \leqq y \leqq 1.999$), preferably of grey-blue, electrically conductive titanium oxide of the formula $TiO_y$ ($1.90 \leqq y \leqq 1.999$) having a rutile structure or a crystal structure similar to rutile. The first coating, which is electrically conductive, is applied to the electrode in amounts of from 50 to 6000, preferably from 100 to 2000 g per m$^2$ of metal surface by flame or plasma spraying on a metal skeleton, preferably of titanium or titanium alloys, which skeleton serves as current conductor and carrier for the first coating. $TiO_y$ oxides having $1.90 \leqq y \leqq 1.999$ can be produced starting from $TiO_2$ under the influence of the high temperatures of flame or plasma spraying. Oxides $TiO_y$ the y value of which is inferior to that cited above may also be produced by flame or plasma spraying, either by establishing a reducing atmosphere or by partial replacement of the $TiO_2$ used by pulverized titanium metal, or by flame or plasma spraying of the pulverized $TiO_y$ oxides. Subsequently, electrochemically active substances are formed and are anchored in the pores or cavities of the coating. "Electrochemically active" are substances being able to electrocatalyze the reaction $2Cl^- \rightarrow Cl_2 + 2e^-$ (on the electrode surface).

As electrochemically active substances, there are employed platinum metals, preferably ruthenium and iridium, as elements or as compounds. The latter may be binary (such as $RuO_2$ or $IrO_2$) or ternary (for example $Co_2RuO_4$) or even higher compounds which for example may contain Co, Fe, Ca, Na, Pb, Tl. Also mixtures with compounds of film-forming metals (such as $RuO_2$ with $TiO_2$) may be used. The activation substances are formed in the following manner: solutions or suspensions of platinum metal compounds (of organic or salt-like nature) and, optionally, base metal compounds (for example of Co or Ti), possibly in the presence of a mineral acid (for example HCl) and solvents (for example butanol or dimethyl formamide) are applied to the first coating. The thermolysis causes then the conversion of the platinum metal compounds to platinum metals (for example Pt) or the oxides thereof (for example $RuO_2$), and the conversion of the base metal compounds to oxides. During the thermal degradation process, the electrochemically active substances thus formed are anchored in the pores or cavities of the first coating. The content of platinum metal is not critical; amounts of from 1 to 100 g/m$^2$, preferably from 5 to 50 g/m$^2$, calculated as noble metal, may be used.

The electrode which is prepared in accordance with this invention is well-suited for longtime operations at high current densities, and even on contact with amalgam, there is practically no activation substance last, because the electrode is non-wettable to an extremely high extent. Moreover, even in case of losses of activation substance, for example by extremely high current densities (short circuit currents) or other exceptional circumstances which cannot be balanced, such an electrode is capable of forming an autoregulative resistance retarding (braking) a short circuit.

The electrode prepared according to the present invention has the following advantages:

1. By choosing suitable application conditions, the thickness and the porosity of the first coating of titanium oxide may be varied in order to attain optimum anchoring conditions and adhesion properties for the activation substance (the inferior limit of the layer thickness is set only by the standard size of the titanium dioxide used).
2. An excellent adhesion of the first coating on the metallic skeleton, for example titanium, can be achieved in aqueous electrolyses under anodic conditions.
3. The resistance to temperature changes of the combination of the first coating with the metal skeleton is excellent even in a thermal after-treatment.
4. The activation first coating is anchored in the substrate in a corrosion-proof manner, so that it is not necessary to produce mixed crystals of titanium oxide and activation substance.
5. The first coating has an excellent electric conductivity.
6. The electrode is non-wettable by amalgam and resistant to amalgam contact.
7. When used as anode, there is autoregulative formation of an effective resistance in order to avoid or prevent the development of a short circuit, thus preserving the electrode.

A relatively high resistance in the first coating of the electrode used as anode can only be formed when the electrochemically active substances are nearly consumed locally, which occurs only in an exceptional situation (for example in the case of a short circuit). In this case, the formation of chlorine in the electrolysis of aqueous chloride solutions is stopped, and an anodic oxidation causes the conversion of the titanium oxide $TiO_y$ to $TiO_2$, so that the electric conductivity is lost and an effective resistance can be developed.

As a result of tests for activating the first coating, known electrochemically active substances are substantially better anchored. There is a considerable increase in lifetime. Particularly iridium and/or ruthenium containing compounds with or without admixed titanium compounds lead to a very good lifetime. This result was not to be expected according to the state of the art, since in the patent literature, the direct application of noble metal containing oxide mixtures to titanium in the form of a thin film is especially emphasized and the efficiency of numerous metal compounds as electrochemically active substances is indicated.

As anode in the electrolysis of alkali chloride, the electrode prepared by the process of the present invention which contains only relatively small amounts of noble metal attains a very long lifetime at high current densities.

The following examples illustrate the invention.

EXAMPLE 1

Coatings of titanium oxide were produced on titanium articles roughened in a sandblast apparatus by means of a plasma burner in a layer thickness of from 0.03 to 0.40 mm (corresponding to 100 to 1200 g/m$^2$). Also layers having a thickness of 1 mm may be easily produced according to this method. Details for plasma spraying can be found in instruction leaflet No. 102 of METCO Incorp. (Westbury, Long Island, N.Y.) dated Sept. 24, 1970. The $TiO_2$ used was product No. 102 of METCO Incorp., but $TiO_2$ of other manufacturers may also be employed.

The coating produced corresponded to the formula $TiO_y$ having $1.90 \leqq y \leqq 1.999$. The subscript y may be influenced by the temperature and the composition of the plasma gases; elevated temperatures for example result in a lower value for y. The samples had the data indicated in Table 1, Nos. 10, 12, 15 and 17. The operation conditions of the plasma burner were the following:

plasma gas: $N_2$, 8–10 liters/min.
carrier gas: 80/20 forming gas, 8 liters/min.
amperage: 300 amperes
voltage: 56 volts The first coating of titanium oxide of the samples was coated according to the indications given in Table 1, Nos. 10, 12, 15 and 17; in the case of coating with Ir by applying a solution of 2 g of $H_2(IrCl_6) \cdot 6\,H_2O$ in 14.5 ml of $H_2O$; in the case of coating with Ru by applying a solution of 1 g of $RuCl_3 \cdot 3\,H_2O$ in 7.9 ml of $H_2O$; and in the case of coating with Ir and Ru by applying a solution of 1 g of $H_2(IrCl_6) \cdot 6\,H_2O$, 1.08 g of $RuCl_3 \cdot 3\,H_2O$ and 15.8 ml of $H_2O$ *). The first coating of sample No. 17 was coated with a titanium and noble metal containing solution according to Beer[1]; a solution of 6.2 ml of butyl alcohol, 0.4 ml of 36% HCl, 3 ml of butyl titanate and 1 g of ruthenium(III) chloride-hydrate being prepared and applied to the titanium oxide surface by means of a brush. The sample was heated in air to 680° C. In the longtime test, the current density of 20 kA/m$^2$ was unusually high even for an alkali chloride electrolysis according to the mercury method. It results from column 7 that the potential of the electrode remained practically unchanged during the test time of 16 453 hours (No. 10), 16 245 hours (No. 12) and 13 908 hours (No. 15), so that an end of the electrode lifetime could not yet be perceived. Under the same conditions, samples were examined which were coated according to the state of the art [1], in which tests (Nos. 1 to 9) a more distinct increase of potential (per unit of time) than in the case of samples 10, 12, 15 and 17 occurred, which increase results in a progressive inactivation of the anode.

[1]German Offenlegungsschrift No. 1,671,422
*)Subsequently, the anodes were heat-treated for 25 to 40 minutes according to Table 1, column 5.

EXAMPLE 2

On a titanium skeleton, after a pretreatment according to Example 1, a titanium oxide layer was produced by means of a flame spraying pistol in accordance with samples 11, 13, 14 and 16 of Table 1. As spraying powder, commercial titanium dioxide was used. The test conditions were the following:

oxygen: 1500 liters/hour
acetylene: 930 liters/hour
cooling air: 20 psi
spraying distance: 75 mm The first coatings so obtained were coated according to the indications in Table 1, Nos. 11, 13, 14 and 16; in the case of coating with Ir by applying a solution of 2 g of $H_2(IrCl_6) \cdot H_2O$ in 14.5 ml of $H_2O$, in the case of coating with Ru by applying a solution of 1 g of $RuCl_3 \cdot 3\,H_2O$ in 7.9 ml of $H_2O$ and in the case of coating with Ir and Ru by applying a solution of 1 g of $H_2(IrCl_6) \cdot 6\,H_2O$, 1.08 g of $RuCl_3 \cdot 3\,H_2O$ and 15.8 ml of $H_2O$*). The sample No. 11 was activated from a solution of iridium and titanium compounds. The conditions of the longtime test were the same as for the samples cited in Example 1. Also in these cases remarkable lifetimes were obtained without the potential having substantially altered as compared to the value at the start.

[1]Subsequently, the anodes were heat-treated for 25 to 40 minutes according to Table 1, column 5.

EXAMPLE 3

The first coating of titanium oxide was produced according to Example 1. The activation was carried out as follows: A solution composed of 1.11 g of $Co(NO_3)_2 \cdot 6\,H_2O$
0.5 g of $RuCl_3 \cdot 3\,H_2O$
1.5 ml of tetrabutyl-ortho-titanate
0.2 ml of hydrochloric acid (36% HCl)
3.1 ml of dimethyl formamide was applied to the titanium oxide coating (225 g/m$^2$) by means of a brush, and subsequently baked in air for 10 minutes at 600° C. This operation was repeated 8 times. After a 10th impregnation of the titanium oxide coating, baking was carried out for 10 minutes at 650° C. Anodes so activated by cobalt ruthenate/titanium dioxide mixtures (see Table 1, No. 18) showed no increase of potential after 2500 hours at a current density of 20 kA/m$^2$ in an alkali chloride/amalgam cell.

EXAMPLE 4

The first coating of titanium oxide was prepared according to Example 2. Activation was carried out as follows: A solution of 0.91 g of $CoCl_2 \cdot 6\,H_2O$
0.5 g of $RuCl_3 \cdot 3\,H_2O$
1.5 ml of linalool
0.2 ml of hydrochloric acid (36% HCl)
4.0 ml of dimethyl formamide was applied to the titanium oxide coating (233 g/m$^2$) in 10 operations as described in Example 3. After 1500 hours at 20 kA/m$^2$ of current density in the alkali chloride/amalgam cell, an increase of potential at these anodes activated with cobalt ruthenate (Table 1, No. 19) was not observed.

TABLE 1

Longtime test in alkali chloride-mercury cell (temperature 80° C; 300 g/l NaCl)

| 1 | 2 | | | | 3 | 4 |
|---|---|---|---|---|---|---|
| | final coating (titanium oxide + electrochemically active substance) g/m$^2$ | | | | noble metal in oxide mixture | noble metal in final coating |
| Test No. | Co | Ru | Ir | Ti-oxide | % | % |
| 1 | — | 10.5 | — | 19.3 | 35.2 | — |
| 2 | — | 11.9 | — | 21.8 | 35.3 | — |
| 3 | — | 9.5 | — | 17.5 | 35.2 | — |
| 4 | — | 12.1 | — | 22.2 | 35.2 | — |
| 5 | — | 8.9 | — | 16.8 | 34.6 | — |
| 6 | — | 11.5 | — | 20.8 | 35.6 | — |
| 7 | — | — | 2.0 | 11.7 | 50.6 | — |
| 8 | — | — | 10.5 | 10.2 | 50.7 | — |
| 9 | — | — | 9.9 | 9.7 | 50.2 | — |
| 10 | — | | 9.0 | 109.2 | — | 8.2 |
| 11 | — | — | 12.3 | 127.0 | — | 9.6 |
| 12 | — | — | 15.0 | 612.0 | — | 2.4 |
| 13 | — | — | 11.0 | 1490.0 | — | 0.7 |
| 14 | — | 4.0 | 6.0 | 205.0 | — | 4.9 |
| 15 | — | 5.1 | 7.0 | 812.0 | — | 1.5 |
| 16 | — | 9.5 | — | 1613.0 | — | 0.6 |

TABLE 1-continued

| Longtime test in alkali chloride-mercury cell (temperature 80° C; 300 g/l NaCl) | | | | | | |
|---|---|---|---|---|---|---|
| 17 | — | 13.0 | — | 1220.0 | — | 1.1 |
| 18 | 24 | 21.0 | — | 225.0 | — | 9.3 |
| 19 | 19 | 16.0 | — | 233.0 | — | 6.9 |

| 5 | 6 | 7 | | 8 | |
|---|---|---|---|---|---|
| heat treatment in air (° C) | Test current density (kA/m²) | Potential (mV) beginning of test | Potential (mV) end of test | test time (h) | |
| 550 | 20 | 1314 | 1445 | 4895 | coating acc. to H. Beer mixed oxides $RuO_2/TiO_2$ |
| 550 | 20 | 1318 | 1410 | 5930 | |
| 600 | 20 | 1325 | 1460 | 4136 | |
| 650 | 20 | 1333 | 1475 | 4090 | |
| 550 | 20 | 1312 | 1400 | 6008 | |
| 500 | 20 | 1323 | 1490 | 6504 | |
| 550 | 20 | 1321 | 1432 | 5107 | |
| 600 | 20 | 1330 | 1410 | 4962 | |
| 650 | 20 | 1345 | 1501 | 4315 | |
| 700 | 20 | 1325 | 1355 | 16453 | electrode samples acc. to invention |
| 650 | 20 | 1330 | 1350 | 17916 | |
| 680 | 20 | 1318 | 1356 | 16245 | |
| 680 | 20 | 1330 | 1342 | 15823 | |
| 700 | 20 | 1341 | 1380 | 12320 | |
| 680 | 20 | 1327 | 1375 | 13908 | |
| 650 | 20 | 1330 | 1342 | 12425 | |
| 650 | 20 | 1341 | 1362 | 14120 | |
| 600/650 | 20 | 1340 | 1345 | 2539 | |
| 600/650 | 20 | 1334 | 1345 | 1547 | |

*Luggin capillary, normal hydrogen electrode

What is claimed is:

1. In a process for the preparation of an electrode for conducting and withstanding relatively high current densities in electrolytic processes, which comprises producing a first coating of titanium oxide on the surface of a metal passive under the conditions of the electrolytic process, applying a solution or suspension containing a platinum metal compound to the first coating and converting said solution or suspension subsequently by heat treatment into an electrochemically active substance containing a platinum metal or oxide thereof, the improvement comprising producing an electrically conductive first coating of said titanium oxide in the amount of from 50 to 6000 g/m² by flame or plasma spraying the titanium oxide onto the surface of said metal.

2. A process as claimed in claim 1, wherein the passive metal, when used as an anode, is resistant under the conditions of aqueous alkali chloride electrolysis.

3. A process as claimed in claim 2, wherein the passive metal consists of a metal of the group IVB to VIB of the Periodic System.

4. A process as claimed in claim 3, wherein the passive metal consists of an alloy containing at least one metal of the group IVB to VIB of the Periodic System.

5. A process as claimed in claim 3, wherein the passive metal consists of titanium.

6. A process as claimed in claim 3, wherein the passive metal consists of a titanium alloy.

7. A process as claimed in claim 1, which comprises producing the first coating of titanium oxide in an amount of from 100 to 2000 g/m² on the surface of the passive metal.

8. A process as claimed in claim 1, wherein the first coating of titanium oxide corresponds to the empirical formula $TiO_y$ having $1.999 \leqq y \leqq 0.1$.

9. A process as claimed in claim 8, wherein y is $\geqq 1.75$.

10. A process as claimed in claim 9, wherein y is $\geqq 1.90$.

11. A process as claimed in claim 9, wherein the first coating of titanium oxide has a rutile structure or a crystal structure similar to rutile.

12. A process as claimed in claim 1, wherein ruthenium dioxide and/or iridium dioxide are used as electrochemically active substance.

13. A process as claimed in claim 1, wherein the content of platinum metals or platinum metal oxides, calculated as platinum metal, is from 1 to 100 g/m², preferably from 5 to 50 g/m².

14. A process as claimed in claim 1, wherein the solution or suspension applied to the first coating contains also titanium compounds.

* * * * *

UNITED STATES PATENT AND TRADEMARK OFFICE

CERTIFICATE OF CORRECTION

PATENT NO. : 4,140,813

DATED : February 20, 1979

INVENTOR(S) : Hund et al.

It is certified that error appears in the above-identified patent and that said Letters Patent are hereby corrected as shown below:

In the Heading, Item [63] and in column 1, line 6, the date "Aug. 15, 1975" should be --Aug. 18, 1975--.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*